US011377938B1

(12) United States Patent
Jamison et al.

(10) Patent No.: US 11,377,938 B1
(45) Date of Patent: Jul. 5, 2022

(54) PERFORATIONS USING FLUIDS CONTAINING HOLLOW SPHERES

(71) Applicant: Halliburton Energy Services, Inc., Houston, TX (US)

(72) Inventors: Dale E. Jamison, Houston, TX (US); Brian Alan Evans, Houston, TX (US); Denise Nicole Benoit, Houston, TX (US); Daniel Joshua Stark, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/558,107

(22) Filed: Dec. 21, 2021

(51) Int. Cl.
*E21B 43/119* (2006.01)

(52) U.S. Cl.
CPC ..... *E21B 43/119* (2013.01); *E21B 43/1195* (2013.01)

(58) Field of Classification Search
CPC .... E21B 43/26; E21B 43/117; E21B 43/1195; E21B 33/13; E21B 43/119; C09K 8/80
See application file for complete search history.

(56) References Cited

U.S. PATENT DOCUMENTS 6,776,237 B2 8/2004 Dao et al.
7,096,944 B2 8/2006 Vargo, Jr. et al.
7,666,807 B2 2/2010 Heung et al.
8,183,186 B2 5/2012 Luo et al.
9,631,132 B2 4/2017 Ravi et al.
2003/0089498 A1* 5/2003 Johnson ..... E21B 43/04 166/55
2005/0167108 A1* 8/2005 Chang ..... E21B 43/1195 175/4.51
2006/0258546 A1* 11/2006 Brannon ..... C09K 8/80 507/269
2010/0236780 A1 9/2010 Hermes et al.
2014/0262529 A1 9/2014 Quintero et al.
2015/0013988 A1 1/2015 Ravi et al.
2017/0198179 A1* 7/2017 Greenbauer ..... E21B 43/261
2017/0210976 A1* 7/2017 Okamoto ..... E21B 43/267
2018/0362838 A1* 12/2018 Skiba ..... E21B 43/267
(Continued)

FOREIGN PATENT DOCUMENTS

CA 3035017 A1 5/2018
EP 3036301 10/2019
(Continued)

OTHER PUBLICATIONS

LaPlante, et al., J. Phys Chem. C 2019, 123, 3687-3695, Enhancing Silicate Dissolution Kinetics in Hyperalkaline Environments, Jan. 2019.

(Continued)

*Primary Examiner* — Daniel P Stephenson
(74) *Attorney, Agent, or Firm* — John Wustenberg; C. Tumey Law Group PLLC

(57) ABSTRACT

Techniques of the present disclosure relate to downhole perforation operations using fluid containing hollow spheres. A method comprising: disposing a perforating apparatus in a volume of hollow particles in a wellbore; and detonating the perforating apparatus to collapse a portion of the hollow particles to increase flow through at least one perforation resulting from a detonation.

20 Claims, 5 Drawing Sheets

(56) References Cited

U.S. PATENT DOCUMENTS

2020/0362233 A1* 11/2020 Lieng ..... E21B 43/04

FOREIGN PATENT DOCUMENTS

GB 2398094 A * 8/2004 ..... E21B 43/117
WO 2010-051165 5/2010

OTHER PUBLICATIONS

3M Hollow Glass Microspheres—Budov, V. V. (1994). Hollow glass microspheres, use, properties, and technology (Review). Glass and Ceramics, 51(7-8), 230-235.

Hollowlite Hollow Glass Microspheres, Available at https://en.hollowlite.com/products/Hollw-Glass-Sphere-HL38.html. Accessed website Nov. 23, 2020.

Trelleborg, Hollow Glass Microspheres, Available at https://www.trelleborg.com/en/applied-technologies/material-excellence/hollow-glass-microspheres. Accessed website Nov. 23, 2020.

Potters, Engineered Glass Materials Division, Hollow Glass Microspheres, Sphericel General PDS-2011-Ir. Available at https://www.pqcorp.com/brands/potters-industries. Accessed website Nov. 23, 2020.

Leong, V. H., & Ben Mahmud, H. (2018). A preliminary screening and characterization of suitable acids for sandstone matrix acidizing technique: a comprehensive review. Journal of Petroleum Exploration and Production Technology.

* cited by examiner

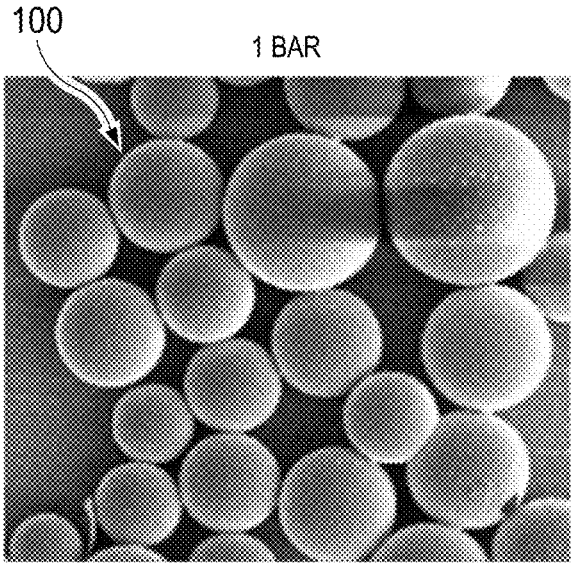
FIG. 1A
FIG. 1B
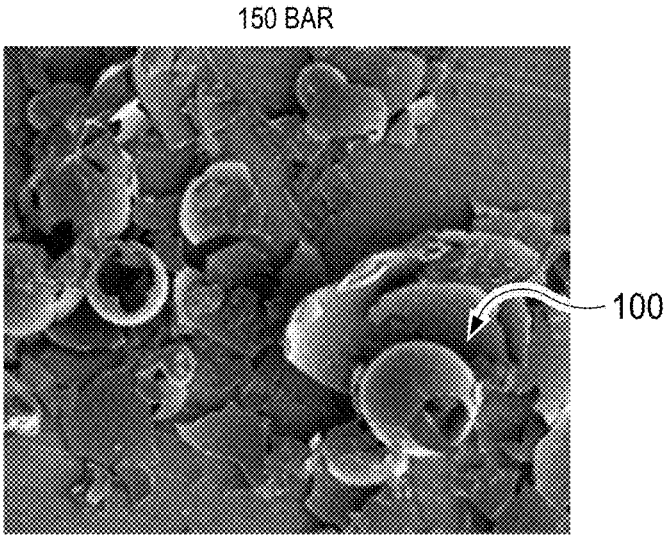
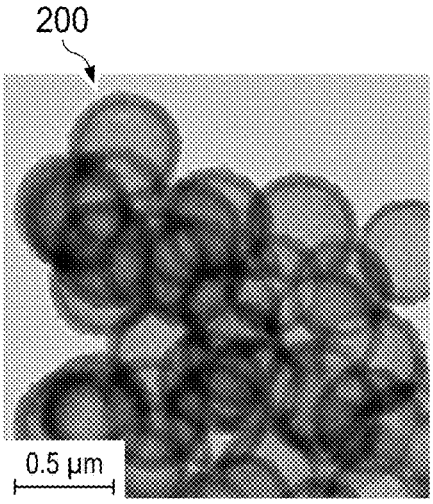
FIG. 2

PERFORATIONS USING FLUIDS CONTAINING HOLLOW SPHERES

BACKGROUND

During perforation operations in wellbores, perforations are created by detonating a series of shaped charges located within the casing string that are positioned adjacent to a subterranean formation. One or more charge carriers are loaded with shaped charges that are connected with a detonating cord. The charge carriers are then connected within a tool string that is disposed into a cased wellbore.

Once the charge carriers are aligned in the wellbore such that shaped charges are adjacent to the formation to be perforated, the shaped charges are detonated. Upon detonation, each shaped charge creates a jet that blasts through a scallop or recess in the carrier. Each jet creates an opening through the casing, the cement, and the formation forming a perforation. Some of the perforations may become obstructed by debris resulting in reduced fluid flow through the perforations.

BRIEF DESCRIPTION OF THE DRAWINGS

These drawings illustrate certain aspects of some of the embodiments of the present method and should not be used to limit or define the method.

FIG. 1A illustrates hollow glass spheres (HGS), in accordance with examples of the present disclosure;

FIG. 1B illustrates collapsed HGS, in accordance with examples of the present disclosure;

FIG. 2 illustrates hollow polymer microcapsules (HPM), in accordance with examples of the present disclosure;

DETAILED DESCRIPTION

Figure 3:
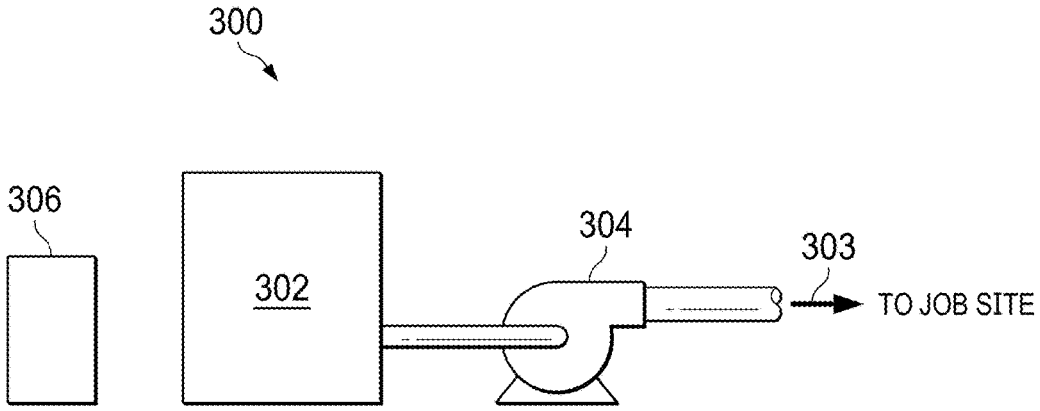
FIG. 3 illustrates a system for the preparation of a composition including the HGS and/or the HPM, in accordance with examples of the present disclosure.

Systems and methods of the present disclosure generally relate to improving perforation/channel cleaning by creating an opportunity for a longer period of time for the debris to be removed/swept from the perforation/channel. This may be accomplished by performing the perforation operation in a fluid containing high volumes of hollow particles such as Hollow Glass Spheres (HGS) and/or Hollow Polymer Microcapsules (HPM). In other examples, rather than spheres, shapes of the hollow glass particles may include rods, dumbbells, cubes, and/or other hollow structures.

Perforating operations using HGS and/or HPM may be performed using spacer fluids containing very high concentrations of HGS and/or HPM. The spacer fluids may be accurately spotted to any depth using various fluid interface/mixing models. The HGS and/or HPM may improve perforation cleanup efficiency when using wireline or tubingconveyed perforating guns that have insufficient internal volume for effective dynamic underbalanced perforating.

Cleaner and longer perforation channels provide the opportunity to improve well production rates and/or recovery. Performing perforating operations in the denser and more viscous HGS and/or HPM spacer fluid improves the complete removal of perforation debris. On detonation of a perforation apparatus, a resulting shock wave may crush the HGS and/or HPM in the vicinity near plasma created by the discharge. The crushed volume of the HGS and/or HPM may be less than the initial sphere volume, resulting in lower pressure in the wellbore. The lower pressure may facilitate wellbore fluid (e.g., formation fluid) to flush the perforation channel debris into the wellbore. This may be achieved by increasing a time for the lower pressure to exist in the wellbore before the material in the wellbore causes the wellbore to return to an overbalanced pressure condition. That is, in some examples, the reduction of spherical volume allows for a temporary duration of an underbalanced pressure condition in the wellbore which may allow for an influx of formation fluid into the wellbore. The influx may remove/clean any debris from the perforations, thereby increasing subsequent fluid flow therethrough.

HGS and HPM suitable for improving perforations may include various sizes and wall thickness. These spheres may be selected and designed to provide maximum volume increase in the low-pressure area created by the HGS and/or HPM being crushed by the perforating gun shock wave. The increased low-pressure volume provides more time for debris to be swept by the formation fluid from the perforation channel.

In particular examples, particles that are un-crushed can be easily circulated from the well following perforating operations. Crushed HGS or HPM particles that remain in perforating tunnels may have much greater porosity and permeability than the perforation crushed zone, so perforation breakdown capability with acid or frac fluid should not be impeded. HGS or HPM usage may facilitate removal of some or most of crushed particles around the perforation, facilitating well completion/stimulation operations.

In some examples, a shear-thickening (dilatant) fluid may be disposed in the casing or gun carrier/body annulus to mitigate HGS and/or HPM crushing, and hence unnecessary debris generation, some distance from the perforation charge.

Also, in some examples, to eliminate the need for using a spacer fluid, the HGS and/or HPM may be coated with a magnetic material that may adhere them to a charge of a perforating device. For example, the HGS and/or HPM may be coated with a thin layer of iron nickel, iron oxides, cobalt, iron, nickel, and their alloys, and/or other ferromagnetic or ferrimagnetic material, then flowed in any fluid. A small magnet next to the charge may concentrate the HGS and/or HPM spheres adjacent to the magnet.

FIG. 1A illustrates HGS 100 before collapsing, in accordance with examples of the present disclosure. HGS 100 are shown in an initial non-collapsed state at 1 bar for example. The HGS may include crush strengths ranging from 600 to 19,000 psi and have a mean particle diameter ranging from 18 to 65 microns.

The particle density g/cc includes ranges from 0.30 to 0.50. The empty volume of the HGS ranges from about 80% to about 90%. Selecting the HGS based on crush strength and the increased low pressure volume potential provides for a perforating fluid can be easily tuned and controlled to maximize the cleaning effect on the perforation channel with HGS particle selection and the volume fraction of particles contained in the fluid.

FIG. 1B illustrates collapsed hollow particles, in accordance with examples of the present disclosure. HGS 100 are shown in a collapsed state at 150 bar, for example. The crushed volume of the HGS or HPM may be less than the initial sphere volume (e.g., see FIG. 1A), resulting in lower pressure in the wellbore. The lower pressure may facilitate formation fluid to flush the perforation channel debris into the wellbore. This may be achieved by increasing a time for the lower pressure to exist in the wellbore (e.g., underbalanced wellbore) before the material in the wellbore causes the wellbore to return to an overbalanced pressure condition.

FIG. 2 illustrates HPM 200 in accordance with examples of the present disclosure. The HPM 200 may include spheres where the size, thickness, and polymer composition of each sphere is tunable for desired crush strength and empty volume. The empty volume of each of the HPM particles ranges from about 80% to about 90%. Features of the HPM 200 may include a tunable particle size (e.g., 200 nm-5 μm); a narrow size distribution (e.g., PDI<1.1); high loading efficiency (e.g., 20-40 wt. %); tunable diameter/radius ratio (e.g., 0.1-0.2); and/or a tunable crush strength.

Selecting the HPM 200 based on crush strength and increased low pressure volume potential may provide for a perforating fluid that may be easily tuned and controlled to maximize the cleaning effect on the perforation channel with HPM particle selection and the volume fraction of particles contained in the fluid.

FIG. 3 illustrates a system 300 for the preparation of a composition including at least the HGS or the HPM, in accordance with examples of the present disclosure. As shown, components may be mixed and/or stored in a vessel 302. The vessel 302 may be configured to contain and/or mix the components to produce a composition 303 (e.g., a spacer fluid) comprising the HPM and/or HGS. Non-limiting examples of the vessel 302 may include drums, barrels, tubs, bins, jet mixers, re-circulating mixers, and/or batch mixers. The composition 303 may then be moved (e.g., pumped via pumping equipment 304) to a location such as a wellbore, for example.

In some examples, the composition 303 may include a shear-thickening (dilatant) fluid mixed with the HGS and HPM to mitigate HGS and/or HPM crushing, and hence unnecessary debris generation, some distance from a perforation charge.

In other examples, to eliminate the need for using a spacer fluid, the HGS and/or the HPM may be coated with a material that may adhere them to a charge of a perforating gun. For example, the HGS and/or HPM may be coated with a thin layer of iron nickel, then flowed in any fluid. A small magnet next to the charge may concentrate the spheres.

The system 300 may also include a computer 306 for calculating desired volumes of the HPM and/or HGS, for example. In some examples, the volume of the HPM and/or HGS in the composition 303 may range from about 1% to about 60% (e.g., about 10% to about 30%).

The computer 306 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The computer 306 may be any processor-driven device, such as, but not limited to, a personal computer, laptop computer, smartphone, tablet, handheld computer, dedicated processing device, and/or an array of computing devices. In addition to having a processor, the computer 306 may include a server, a memory, input/output ("I/O") interface(s), and a network interface. The memory may be any computer-readable medium, coupled to the processor, such as RAM, ROM, and/or a removable storage device for storing data and a database management system ("DBMS") to facilitate management of data stored in memory and/or stored in separate databases.

The computer 306 may also include display devices such as a monitor featuring an operating system, media browser, and the ability to run one or more software applications. Additionally, the computer 306 may include non-transitory computer-readable media. Non-transitory computer-readable media may include any instrumentality or aggregation of instrumentalities that may retain data and/or instructions for a period of time.

Figure 4:
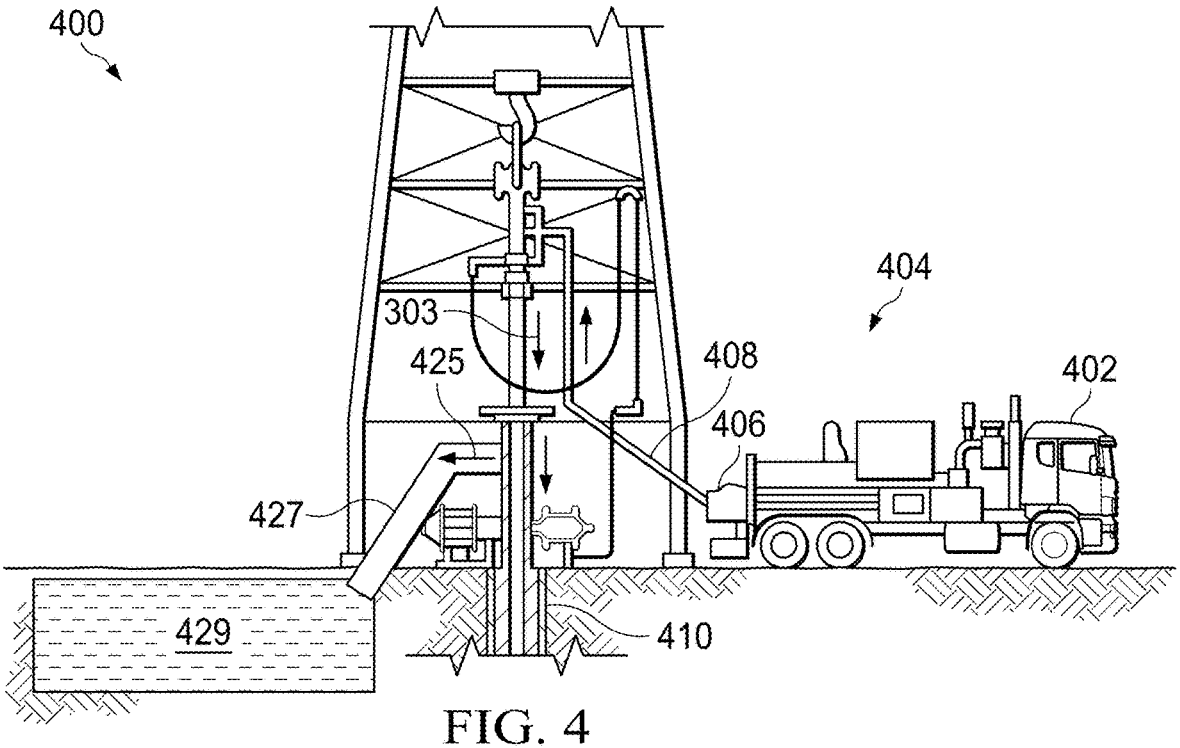
FIG. 4 illustrates a system that may be used for the placement of the composition, in accordance with examples of the present disclosure.

FIG. 4 illustrates a system 400 that may be used in the placement of the composition 303 that includes the HGS and/or the HPM, in accordance with examples of the present disclosure. It should be noted that while FIG. 4 generally depicts a land-based operation, those skilled in the art will readily recognize that the principles described herein are equally applicable to subsea operations that employ floating or sea-based platforms and rigs, without departing from the scope of the disclosure.

The system 400 may include a unit 402, which may include one or more trucks, for example. The unit 402 may include mixing equipment 404 and pumping equipment 406. The unit 402 may pump the composition 303, through a feed pipe 408 which conveys the composition 303 into a downhole environment (e.g., a wellbore 410). Circulated fluids 425 from the wellbore 410 may pass into a flow line 427 and be deposited, for example, in one or more retention pits 429.

Figure 5:
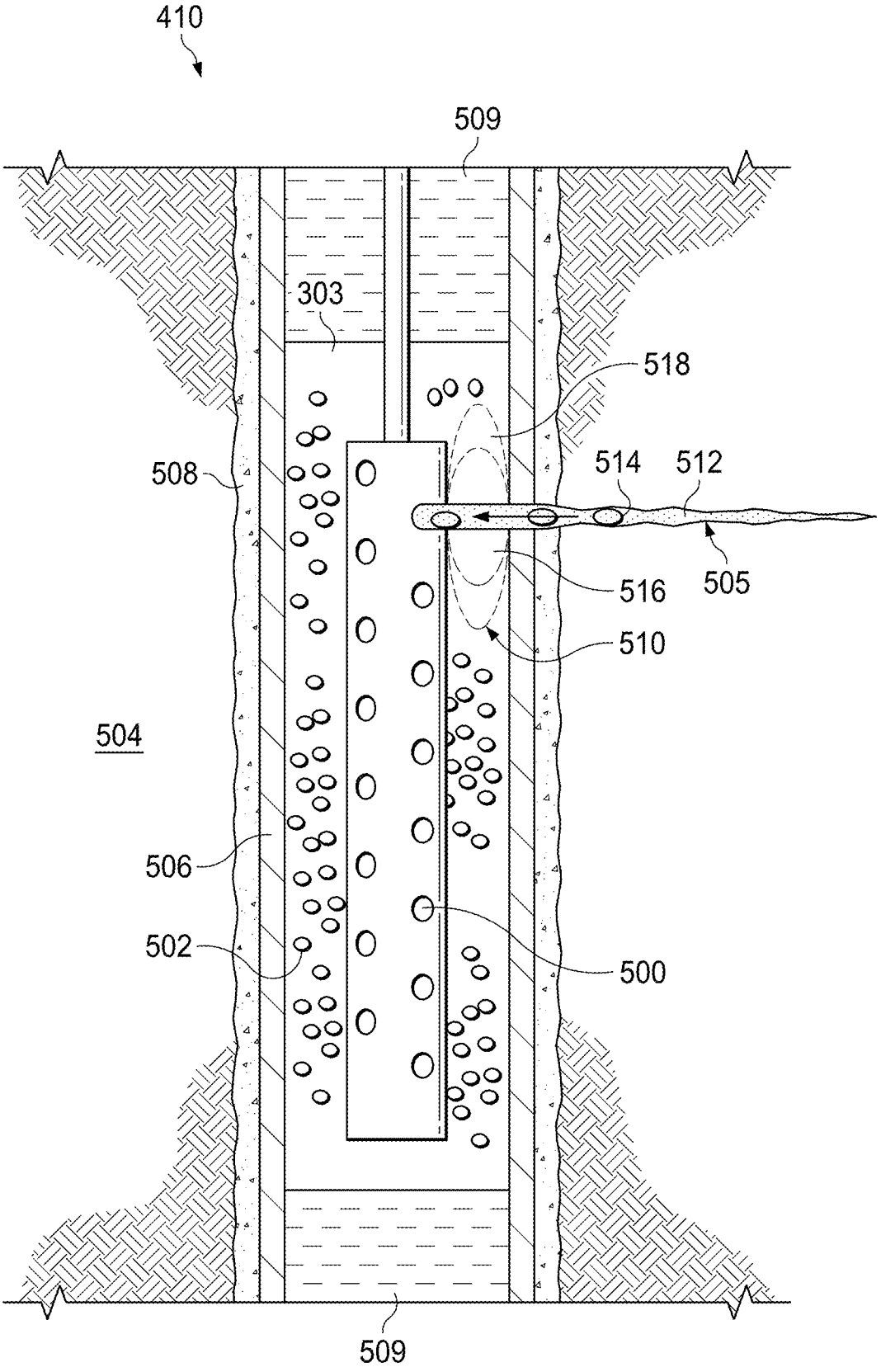
FIG. 5 illustrates a downhole perforating apparatus disposed in HGS and/or HPM, in accordance with particular examples of the present disclosure.

FIG. 5 illustrates a downhole perforating apparatus 500 disposed in HGS and/or HPM, in accordance with examples of the present disclosure. Particles 502 may represent HGS and/or HPM within the wellbore 410. In some examples, the particles 502 may be configured in a cubic packing arrangement having about 45% to 50% (e.g., 47%) porosity. In other examples, the particles 502 may be configured in an orthorhombic arrangement having about 40% porosity.

The composition 303 may be placed in a subterranean formation 504. The wellbore 410 may be drilled into the subterranean formation 504. While the wellbore 410 is shown generally extending vertically into the subterranean formation 504, the principles described herein are also applicable to wellbores that extend at an angle through subterranean formation 504, such as horizontal and slanted wellbores.

Casing 506 may be disposed in the wellbore 410 and may be cemented in place by a cement sheath 508. The composition 303 may be pumped down the interior of the casing 506. The composition 303 may separate other fluids 508, such as, drilling fluids and/or cement slurries present in the interior of the casing 506. In some examples, a volume fraction of the particles 502 may be determined by a volume of space downhole between the outside diameter of the perforating apparatus 500 and a casing inside diameter, or a volume fraction of a slurry containing the particles 502 and a carrier fluid. The composition 303 may contain between 10% and 30% HGS or HPM by volume of the annular space. In some examples, no more than about 60% of the volume of the annular space may be occupied with the particles 502.

The downhole perforating apparatus 500 may detonate to perforate (e.g., perforations/channels 505) the casing 506, the cement sheath 508, and the formation 504. On detonation of the perforation apparatus 500, a resulting shock wave 510 may crush the HGS or HPM (e.g., particles 502) in the vicinity near plasma created by the discharge. The crushed volume of the HGS or HPM may be less than the initial sphere volume of the particles 502, resulting in lower pressure in the wellbore 410. The lower pressure may facilitate wellbore fluid (e.g., formation fluid 512) to flush the perforation channel debris 514 into the wellbore 410.

This may be achieved by increasing a time for the lower pressure to exist in the wellbore before the material (e.g., the composition 303, the fluid 509) in the wellbore 410 causes the wellbore 410 to return to an overbalanced pressure condition. That is, in some examples, the reduction of spherical volume (e.g., collapsed particles 502) allows for a temporary duration of an underbalanced pressure condition in the wellbore 410 which may allow for an influx of the formation fluid 512 into the wellbore 410. The influx may remove/clean any of the debris 514 from the perforations 505, thereby increasing subsequent fluid flow therethrough. A normal influx volume 516 is shown compared to the improved influx volume 51 due to the collapsed particles 502.

In some examples, the underbalanced pressure condition may include a dynamic underbalanced pressure condition where a very short-lived (e.g., a few milliseconds) low pressure state initiates flow from the subterranean formation 504 (e.g., a reservoir) to the casing 506 until the perforating apparatus 500 has filled with annular fluid under an extreme pressure differential (e.g., atmospheric pressure in the hollow perforating apparatus 500 and hydrostatic head in the annulus surrounding the perforating apparatus 500).

Figure 6:
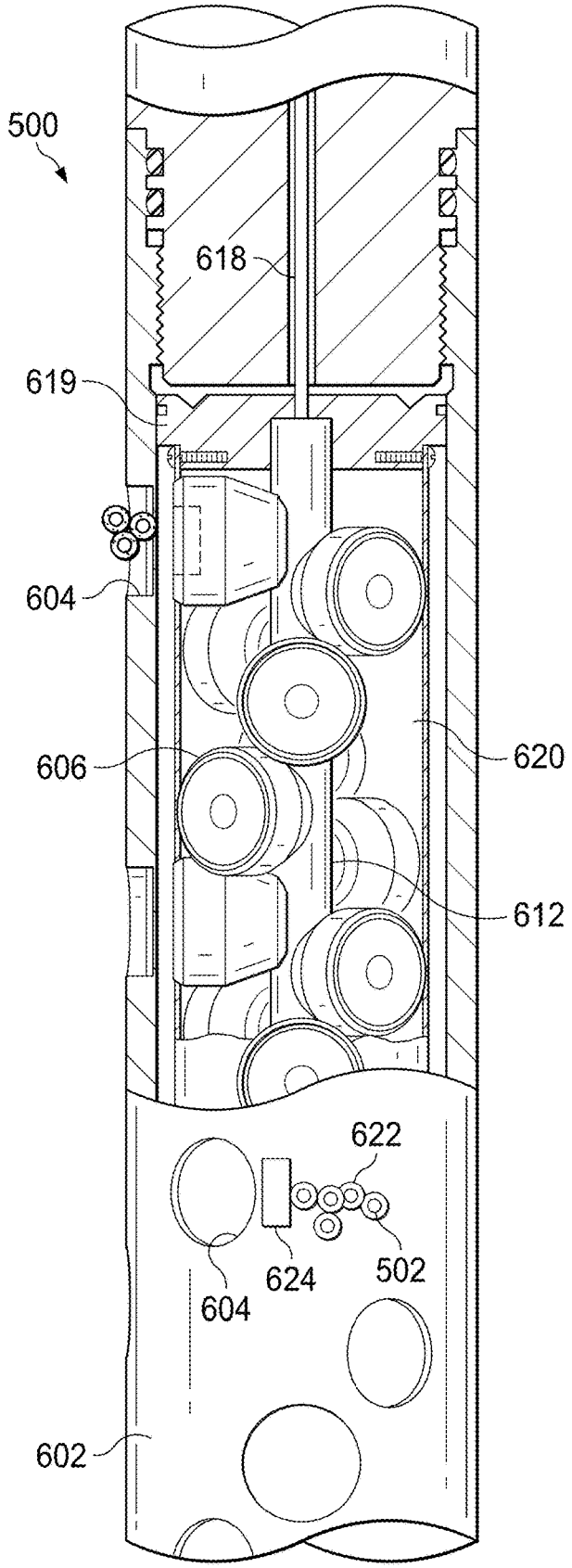
FIG. 6 illustrates a cut-away view of the perforating apparatus, in accordance with examples of the present disclosure.

FIG. 6 illustrates a cut-away view of the perforating apparatus 500, in accordance with examples of the present disclosure. The apparatus 500 may include a gun body 602 made of a cylindrical sleeve having a plurality of radially reduced areas depicted as scallops or recesses 604. Radially aligned with each of the recesses 604 is a respective one of a plurality of shaped charges 606. The shaped charges 606 are retained within the gun body 102 by a charge holder 612. Disposed within the charge holder 612 is a detonator cord 618 to detonate the shaped charges 606.

In some examples, a shear-thickening (dilatant) fluid 619 may be disposed in the apparatus 500 to mitigate HGS and/or HPM crushing, and hence unnecessary debris generation, some distance from the shaped charge 606. In some examples, the fluid 619 may be disposed to contact and surround the shaped charges 606 (e.g., within an annulus 620 of the apparatus 500).

In some examples, the HGS and/or the HPM (e.g., the particles 502) may be coated with a material 622 that may adhere them to a charge 606 of the apparatus 500 to eliminate the need for using a spacer fluid. For example, the HGS and/or HPM may be coated with a thin layer of iron nickel, then flowed in any fluid. At least one magnet(s) 624 may be disposed adjacent to each of the charged 606 which may concentrate the particles 502 in an area. The magnets 624 may be disposed inside or outside of the apparatus 500.

Figure 7:
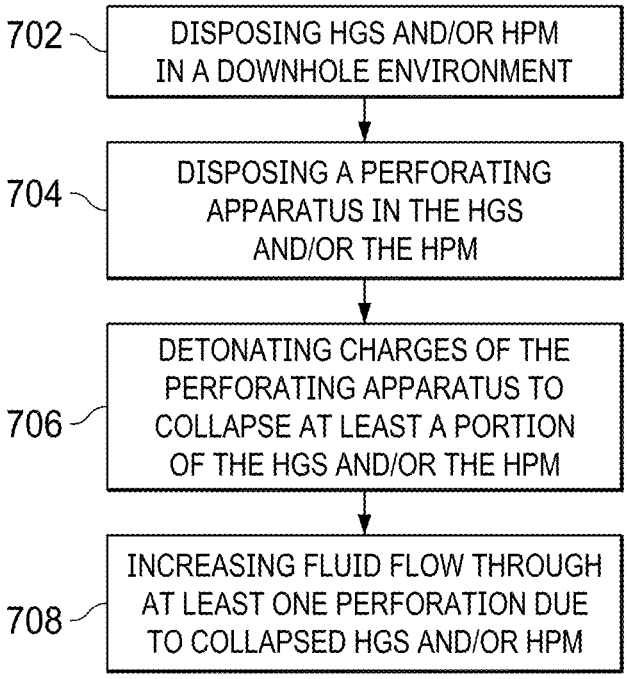
FIG. 7 illustrates and operative sequence for detonating charges in a subterranean formation, in accordance with examples of the present disclosure.

FIG. 7 illustrates and operative sequence for detonating charges in a subterranean formation, in accordance with examples of the present disclosure. At step 700, the HGS and/or the HPM may be disposed in a downhole environment (e.g., see FIG. 5). At step 702, a perforating apparatus (e.g., a perforating gun) may be disposed in the HGS and/or the HPM (e.g., see FIG. 5). At step 704, charges of the perforating apparatus may be detonated to collapse at least a portion of the HGS and/or the HPM adjacent the charge (e.g., see FIG. 5). At step 706, perforations/channels may be cleaned to improve formation fluid therethrough due to collapsing of the portion of the HGS and/or the HPM.

Accordingly, the present disclosure may relate to techniques for improving perforation/channel cleaning by creating an opportunity for a longer period of time for the debris to be removed/swept from the perforation/channel. The systems and methods may include any of the various features disclosed herein, including one or more of the following statements.

Statement 1. A method comprising: disposing a perforating apparatus in a volume of hollow particles in a wellbore; and detonating the perforating apparatus to collapse a portion of the hollow particles to increase flow through at least one perforation resulting from a detonation.

Statement 2. The method of the statement 1, wherein the disposing the perforating apparatus in a volume of hollow particles comprises disposing the perforating apparatus in hollow glass spheres (HGS) and/or hollow polymer microcapsules (HPM).

Statement 3. The method of any of the preceding statements, further comprising disposing the hollow particles in a spacer fluid.

Statement 4. The method of any of the preceding statements, further comprising reducing pressure in the wellbore with collapsed hollow particles.

Statement 5. The method of any of the preceding statements, further comprising cleaning debris from the at least one perforation due to collapsed hollow particles.

Statement 6. The method of any of the preceding statements, further comprising applying a magnetic force to the hollow particles with the perforating apparatus.

Statement 7. The method of any of the preceding statements, further comprising reducing collapsing of the hollow particles in the wellbore with a dilatant.

Statement 8. The method of any of the preceding statements, further comprising reducing collapsing of the hollow particles with a dilatant that is disposed within the perforating apparatus.

Statement 9. The method of any of the preceding statements, further comprising increasing a time for an underbalanced pressure condition in the wellbore due to collapsed hollow particles.

Statement 10. The method of any of the preceding statements, further comprising coating the hollow particles with a magnetic material.

Statement 11. A system comprising: a perforating apparatus; and hollow particles operable to receive the perforating apparatus, wherein a portion of the hollow particles are operable to collapse upon detonation of the perforating apparatus to increase flow through a perforation in a wellbore.

Statement 12. The system of any of the statement 11, wherein the hollow particles comprise hollow glass spheres (HGS) and/or hollow polymer microcapsules (HPM).

Statement 13. The system of the statement 11 or the statement 12, further comprising a spacer fluid, the hollow particles disposed in the spacer fluid.

Statement 14. The system of any of the statements 11-13, wherein the perforating apparatus comprises a magnet.

Statement 15. The system of any of the statements 11-14, wherein the hollow particles comprise a magnetic coating.

Statement 16. The system of any of the statements 11-15, wherein the perforating apparatus comprises a dilatant.

Statement 17. The system of any of the statements 11-16, further comprising a dilatant disposed with the hollow particles.

Statement 18. The system of any of the statements 11-17, further comprising a portion of collapsed hollow particles.

Statement 19. The system of any of the statements 11-18, wherein most of each hollow particle includes empty space.

Statement 20. The system of any of the statements 11-19, wherein a crush strength of each hollow particle is tunable.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

lowering a perforating apparatus into a fluid comprising hollow particles, the fluid disposed in a wellbore; and detonating the perforating apparatus to collapse a portion of the hollow particles to increase flow through at least one perforation resulting from a detonation.

2. The method of claim 1, wherein the disposing the perforating apparatus in a volume of hollow particles comprises disposing the perforating apparatus in hollow glass spheres (HGS) and/or hollow polymer microcapsules (HPM).

3. The method of claim 1, further comprising disposing the hollow particles in a spacer fluid.

4. The method of claim 1, further comprising reducing pressure in the wellbore with collapsed hollow particles.

5. The method of claim 1, further comprising cleaning debris from the at least one perforation due to collapsed hollow particles.

6. The method of claim 1, further comprising applying a magnetic force to the hollow particles with the perforating apparatus.

7. The method of claim 1, further comprising reducing collapsing of the hollow particles in the wellbore with a dilatant.

8. The method of claim 1, further comprising reducing collapsing of the hollow particles with a dilatant that is disposed within the perforating apparatus.

9. The method of claim 1, further comprising increasing a time for an underbalanced pressure condition in the wellbore due to collapsed hollow particles.

10. The method of claim 1, further comprising coating the hollow particles with a magnetic material.

11. A system comprising:

a perforating apparatus comprising a magnet; and hollow particles operable to receive the perforating apparatus, wherein a portion of the hollow particles are operable to collapse upon detonation of the perforating apparatus to increase flow through a perforation in a wellbore.

12. The system of claim 11, wherein the hollow particles comprise hollow glass spheres (HGS) and/or hollow polymer microcapsules (HPM).

13. The system of claim 11, further comprising a spacer fluid, the hollow particles disposed in the spacer fluid.

14. The system of claim 11, wherein the perforating apparatus further comprises a charge, wherein the magnet is adjacent to the charge.

15. The system of claim 11, wherein the hollow particles comprise a magnetic coating.

16. The system of claim 11, wherein the perforating apparatus comprises a dilatant.

17. The system of claim 11, further comprising a dilatant disposed with the hollow particles.

18. The system of claim 11, further comprising a portion of collapsed hollow particles.

19. The system of claim 11, wherein most of each hollow particle includes empty space.

20. The system of claim 11, wherein a crush strength of each hollow particle is tunable.

* * * * *